US007927038B2

(12) United States Patent
Dawson et al.

(10) Patent No.: US 7,927,038 B2
(45) Date of Patent: Apr. 19, 2011

(54) METHOD OF SEALING JOINTS IN ROAD SURFACES AND SUBSURFACES

(75) Inventors: Delbert L. Dawson, Mansfield, OH (US); Colin Durante, Mansfield, OH (US)

(73) Assignee: D&D Emulsions, Inc., Mansfield, OH (US)

( * ) Notice: Subject to any disclaimer, the term of this patent is extended or adjusted under 35 U.S.C. 154(b) by 152 days.

(21) Appl. No.: 12/315,586

(22) Filed: Dec. 4, 2008

(65) Prior Publication Data

US 2010/0143035 A1 Jun. 10, 2010

Related U.S. Application Data

(63) Continuation of application No. 11/483,282, filed on Jul. 7, 2006, now abandoned.

(51) Int. Cl.
*E01C 11/24* (2006.01)

(52) U.S. Cl. ..... 404/72; 404/75; 404/107

(58) Field of Classification Search ..... 404/107, 404/75, 72

See application file for complete search history.

(56) References Cited

U.S. PATENT DOCUMENTS

| | | | | | |
|---|---|---|---|---|---|
| 3,763,074 | A * | 10/1973 | Rostler | 524/475 |
| 3,900,692 | A * | 8/1975 | Rostler | 428/489 |
| 4,017,446 | A * | 4/1977 | Rion | 524/475 |
| 4,021,393 | A * | 5/1977 | McDonald | 524/64 |
| 4,358,554 | A * | 11/1982 | Yan et al. | 524/69 |
| 4,745,155 | A * | 5/1988 | Grossi | 525/54.5 |
| 5,439,313 | A * | 8/1995 | Blaha et al. | 404/75 |
| 6,315,492 | B1 * | 11/2001 | McIntosh | 404/17 |
| 2005/0215673 | A1 * | 9/2005 | Takamura | 524/59 |
| 2006/0104716 | A1 * | 5/2006 | Jones | 404/77 |
| 2009/0092846 | A1 * | 4/2009 | Takamura et al. | 428/480 |

* cited by examiner

*Primary Examiner* — Raymond W Addie
(74) *Attorney, Agent, or Firm* — Carr & Ferrell LLP

(57) ABSTRACT

A method of sealing and strengthening the joints in an asphalt road surface and subsurface to prolong the useful life of the road utilizes a polymer modified cationic maltene emulsion containing polymer modified maltene oils and resins, and surfactants/and wetting agents. The emulsion is applied to the longitudinal joints and other joints in the asphalt pavement surface. The emulsion reduces voids in the asphalt pavement and chemically improves the asphalt binder properties, thereby altering the modulus of elasticity of the asphalt binders so that the resistance of the pavement to tension is increased, and the water absorption of the pavement is reduced.

3 Claims, No Drawings

METHOD OF SEALING JOINTS IN ROAD SURFACES AND SUBSURFACES

CROSS-REFERENCE TO RELATED APPLICATIONS

This application is a continuation of Applicants' U.S. application Ser. No. 11/483,282, now abandoned. Applicants hereby claim priority of U.S. application Ser. No. 11/483,282.

BACKGROUND OF THE INVENTION

1. Field of the Invention

The present invention relates generally to road construction, and more particularly is a method of prolonging the useful life of a road surface by sealing and strengthening the joints created during the paving process.

2. Description of the Prior Art

Highway paving is a huge industry. There are over 2.5 million miles of paved roads in the United States alone. Depending on the weather and level of usage the road surface may have to be repaired or replaced every 3-5 years. This represents a huge financial burden on the entity responsible for road maintenance.

One of the chief factors leading to premature road surface breakdown is cracking and disintegration around the joints between the sections (lanes) of asphalt pavement. There are two main causes leading to the formation of cracks in the joints between the lanes of asphalt pavement. The first area of premature deterioration causation is the temperature effect. First, the asphalt pavement shrinks as the ambient temperature drops during a seasonal temperature change. Asphalt pavements are strong when subjected to compressive loads; however, asphalt pavements do not have nearly as much resistance when subjected to tension (pulling apart) forces. The tension created by shrinkage, which occurs when the temperature decreases, is therefore very damaging to an asphalt surface, particularly around the joints. Second, the asphalt binder or glue used in the pavement deteriorates when subjected to heat. The manufacturing process used to make asphalt paving mixture by necessity subjects the asphalt binder material to high heat. Summer temperatures also heat the asphalt and contribute to the deterioration of the asphalt binder material, thereby reducing the resistance of the asphalt to stress, particularly to tension forces. The effects of the reduced resistance of the asphalt to cracking are most prevalent at the joint areas, where the asphalt pavement matrix is weakest.

The second chief cause of premature deterioration is the lack of compaction at the edges of a given asphalt pavement section. The area at and adjacent to the longitudinal joint of two asphalt highway lanes is difficult to compact during initial construction. The area to either side of the longitudinal joint (roughly plus or minus one foot from the joint) has less density or compaction than the balance of the pavement. The problem then is water and air intrusion into the area that is not as highly compacted. Water strips the asphalt coating from the asphalt pavement aggregate, thereby weakening the bond between coated aggregate pieces. In addition water absorbed in the critical non-compacted area freezes in winter conditions, causing mechanical damage to the area. Air entry into the pavement structure accelerates oxidation of the asphalt binder reducing its glue-like properties.

Accordingly, it is an object of the present invention to provide a method of sealing and strengthening the joint areas in asphalt paved highways.

It is another object of the present invention to provide an in-depth sealing method that increases the water resistance of the asphalt paving material.

A further object of the present invention is to provide a sealant that not only seals the asphalt road surface, but also reduces internal voids in the asphalt beneath the road surface, providing an in-depth sealing effect.

SUMMARY OF THE INVENTION

The present invention is a method of sealing the joints in an asphalt road surface and subsurface to prolong the useful life of the road. The sealing method utilizes a polymer modified cationic maltene emulsion containing polymer modified maltene oils and resins and surfactants/wetting agents. The emulsion is applied to the longitudinal joints in the asphalt pavement surface. The emulsion penetrates into the asphalt pavement, combining chemically with the asphalt coating on the aggregate, thereby altering the modulus of elasticity of the asphalt binders so that the resistance of the pavement structure to tension is increased, and water absorption into the pavement is reduced.

An advantage of the present invention is that it significantly reduces the amount and magnitude of cracking damage to an asphalt road surface over and adjacent to joints.

Another advantage of the present invention is that it is easy to apply during new road surface construction.

A still further advantage of the present invention is that it is very cost effective in terms of resurfacing savings as compared to the cost of applying the sealing emulsion of the present invention.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

The present invention is a method of sealing and strengthening the joints in an asphalt road surface and subsurface to prolong the useful life of the road. The sealing method utilizes a polymer modified cationic maltene emulsion containing polymer modified maltene oils and resins, surfactants, and wetting agents.

The emulsion is applied to the longitudinal joints in the asphalt surface. When an asphalt road is constructed, the area around the center longitudinal joint or joints is difficult to properly compact. The joint itself, and a surrounding band approximately a foot wide on either side of the joint, cannot be compacted as thoroughly as the main body of the asphalt pavement. The asphalt pavement in the joint area is more porous than the other areas of the asphalt pavement, and is therefore more susceptible to water permeation, oxidation, and tension force damage.

The emulsion is typically sprayed onto the road surface. A spray bar two to three feet wide and two to three inches in diameter, with one-eighth inch nozzles is used in the preferred embodiment to spray the emulsion onto the road surface. The application rate is controlled by a computerized flow manager, which allows the emulsion to be precisely applied to the joint area of the road surface. Once the flow rate computer has been set to the desired application rate, the application of the emulsion is very accurate due to the computer control of the flow, regardless of travel speed variations of the sprayer. Because the joint area is less compacted than the main part of the road surface, the application rate necessary for the joint area is much higher than could be absorbed in the main surface area. For this reason, conventional application methods cannot be used to effectively seal the joint area. Using conventional methods that cover the entire width of the road, if the flow rate is made high enough to seal the voids in the joint area, the main road surface cannot absorb the emulsion.

While the preferred embodiment of the invention uses an automated sprayer to apply the emulsion, any means suitable for application of a liquid emulsion could be effectively used provided the required accuracy of application is maintained.

After it has been applied to the asphalt pavement, the emulsion of the present invention reduces the voids in the asphalt pavement, both on the top surface and beneath the surface. The emulsion alters the modulus of elasticity of the binders in the asphalt pavement mixture, strengthening the asphalt binders and introducing rubber-like properties to the surface and below the surface throughout the joint area and the bordering band where the emulsion is applied. The increased elasticity of the asphalt pavement increases its resistance to tension forces. The application of the emulsion also reduces the water absorption of the asphalt pavement. These two factors, tension damage and water permeation, are the chief components of premature asphalt surface damage.

The emulsion is formed from selected oils and resins extracted from a crude oil source, with a rubber component added after the emulsion has been prepared. The base oil of the emulsion is a petroleum resin. In the preferred embodiment, Petroleum Resin C.A.S. 64742-04-7 or 64742-11-6 is chosen. The base resin is mixed with water, emulsifiers, and a polymer compound. In the preferred embodiment the polymer compound is Surfonic NP-95 or Witcolnol NP-100, and the emulsifier is E-11 Redicote or AA-57. The emulsion comprises, as a percentage by weight, 58%-60% petroleum resin, 36.75% water, 3% polymer compound, and 2.25% emulsifier.

The emulsion is prepared so as to minimize the particle size in order to give the emulsion maximum penetrating capability. The components are mixed in a colloid mill that provides for a particle size setting of 0.018-0.025. However, milling alone will not provide optimal preparation of the emulsion. The base oil is heated to 200°-208° F. to increase the volume. The water is heated to 100°-120° F. The heating causes the particles to expand. the colloid mill setting is therefore applied to an increased particle size. When the mixture is cooled to ambient temperature, the particle size of the emulsion is reduced to less than the original mill setting. In order to give the emulsion more rubber-like properties, rubber in the amount of 2% by volume is added to the emulsion. The rubber chosen for the preferred embodiment is styrene butadiene polymer, or unvulcanized synthetic virgin rubber.

The process of the present invention has shown excellent performance in field testing. In a first test application, the emulsion of the present invention was applied to alternating sections of a new construction asphalt road surface. The untreated sections of the road surface served as control areas. The emulsion was applied to 300 foot long sections two feet wide centered on the longitudinal joint. The application rate was 0.10 gallons per square yard. After three years, visual inspection was made of the test surface. Photographic records show marked differences in the condition of the surface. Those areas adjacent to the joints that were treated with the emulsion equaled or exceeded the performance of the highly compacted areas of the road surface away from the longitudinal joint. Those areas adjacent the joint that were not treated with the emulsion showed significant deterioration that required repair or replacement.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A method of sealing joints in an asphalt pavement surface comprising the following steps:

(a) preparing a non-asphalt emulsion that includes a rubber component and that combines with at least one binder in asphalt pavement to create a rubberized sealant, the emulsion being prepared with a heated milling process so that particle sizes in the emulsion are increased by the heating, the particle sizes being reduced to less than a mill setting after the particles have cooled, so that application of the emulsion alters the modulus of elasticity of the binders of the asphalt surface by filling voids in the asphalt pavement surface material;

(b) applying the emulsion only to a joint area in a newly laid asphalt surface with an application rate sufficient to fill voids in the joint area; and (c) allowing the emulsion to dry, thereby sealing and strengthening the joint area in the asphalt pavement surface so as to delay deterioration of the asphalt pavement surface.

2. The method of claim 1, wherein the emulsion comprises at least one polymer modified maltene resin and at least one surfactant/wetting agent.

3. The method of claim 1, wherein the emulsion is applied with a sprayer.

* * * * *